US010245637B2

(12) United States Patent
Marcin et al.

(10) Patent No.: US 10,245,637 B2
(45) Date of Patent: Apr. 2, 2019

(54) LOW MODULUS SHOT SLEEVE FOR HIGH TEMPERATURE DIE CASTING

(71) Applicant: United Technologies Corporation, Farmington, CT (US)

(72) Inventors: John Joseph Marcin, Marlborough, CT (US); Dilip M. Shah, Glastonbury, CT (US); Carl R. Verner, Windsor, CT (US); Albert Rabinovich, West Hartford, CT (US); Weiduo Yu, Southington, CT (US); Thomas N. Slavens, Moodus, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 222 days.

(21) Appl. No.: 15/248,235

(22) Filed: Aug. 26, 2016

(65) Prior Publication Data

US 2018/0056380 A1 Mar. 1, 2018

(51) Int. Cl.
*B22D 17/20* (2006.01)

(52) U.S. Cl.
CPC ..... *B22D 17/2023* (2013.01); *B22D 17/2038* (2013.01)

(58) Field of Classification Search
CPC ..... B22D 17/2023; B22D 17/2038
USPC ..... 164/113, 303–318
See application file for complete search history.

(56) References Cited

U.S. PATENT DOCUMENTS

| | | | | |
|---|---|---|---|---|
| 5,012,856 | A * | 5/1991 | Zecman | B22D 17/2023 164/113 |
| 6,969,240 | B2 * | 11/2005 | Strangman | B23P 15/006 415/191 |
| 7,338,259 | B2 | 3/2008 | Shah et al. | |
| 8,206,117 | B2 * | 6/2012 | Strangman | B23P 15/006 29/889.21 |
| 2012/0111526 | A1 * | 5/2012 | Bochiechio | B22D 17/2023 164/303 |
| 2016/0031006 | A1 | 2/2016 | Shah et al. | |
| 2017/0030289 | A1 | 2/2017 | Okawa et al. | |

FOREIGN PATENT DOCUMENTS

| | | | |
|---|---|---|---|
| EP | 2450126 | A2 | 5/2012 |
| WO | 2014164593 | A1 | 10/2014 |

OTHER PUBLICATIONS

Hastelloy, http://www.haynesintl.com/alloys/alloy-portfolio_/High-temperature-Alloys/HASTELLOY-X-alloy (Year: 2015).*
Waspaloy, http://www.haynesintl.com/alloys/alloy-portfolio_/High-temperature-Alloys/haynes-waspaloy-alloy (Year: 2015).*
European Search Report, European Application No. 17187357.3, dated Dec. 19, 2017, European Patent Office; European Search Report 8 pages.
Sims et al. "SUPERALLOY II", John Wiley & Sons (1987) 4 pages.

* cited by examiner

*Primary Examiner* — Kevin E Yoon
(74) *Attorney, Agent, or Firm* — Cantor Colburn LLP

(57) ABSTRACT

Shot sleeves for high temperature die casting include a nickel-based alloy having a low modulus single crystal with axi-symmetric orientation.

11 Claims, 2 Drawing Sheets

LOW MODULUS SHOT SLEEVE FOR HIGH TEMPERATURE DIE CASTING

BACKGROUND

The subject matter disclosed herein generally relates to a shot sleeve for a die casting process and, more particularly, to low modulus shot sleeves for high temperature die casting.

A die casting process utilizes a mold cavity defined between mold parts. Molten metal material is feed in to the mold cavity and held under pressure until the metal hardens. The mold parts are then separated and the cast part removed. In some processes a shot sleeve is utilized to hold molten material and introduce that material to the cavity. The shot sleeve includes an opening for introducing molten material into a bore of the shot sleeve that leads to the mold cavity. A plunger or piston moves within the bore of the shot sleeve to push the molten material through the shot sleeve and inject the molten material into the mold cavity. The piston is subsequently withdrawn and additional material can be introduced into the bore for fabricating another part within the same mold cavity, i.e., the shot sleeve is reused for multiple molding operations (e.g., die casting operations).

The shot sleeve can experience very high temperatures due to the molten metal material that is passed through the bore of the shot sleeve. Accordingly, the shot sleeve and/or components thereof are fabricated of materials compatible with such high temperatures. However, materials that are compatible with the high temperatures encountered during the die casting process can be costly and difficult to machine. Further, materials that are compatible with the high temperatures may result in shot sleeves with relatively low life cycles. That is, the high temperatures can lead to failure of the shot sleeves, even when the shot sleeve is formed from high temperature materials. Accordingly, it is desirable to design and develop shot sleeves that can withstand the high temperatures while reducing cost, easing manufacturing, and/or increasing the life cycle of shot sleeves.

SUMMARY

According to some embodiments, shot sleeves for high temperature die casting include a nickel-based alloy having a low modulus single crystal with axi-symmetric orientation.

In addition to one or more of the features described above, or as an alternative, further embodiments of the shot sleeve may include that the single crystal, nickel-based alloy has a first axis with a modulus of 18-22 Mpsi at room temperature.

In addition to one or more of the features described above, or as an alternative, further embodiments of the shot sleeve may include that the first axis modulus in 16-20 Mpsi.

In addition to one or more of the features described above, or as an alternative, further embodiments of the shot sleeve may include that the single crystal, nickel-based alloy has a radial direction with a modulus of 18-22 Mpsi.

In addition to one or more of the features described above, or as an alternative, further embodiments of the shot sleeve may include that the radial direction modulus is 28-32 Mpsi.

In addition to one or more of the features described above, or as an alternative, further embodiments of the shot sleeve may include that the single crystal, nickel-based alloy has a tangential or hoop direction with a modulus of 18-22 Mpsi.

In addition to one or more of the features described above, or as an alternative, further embodiments of the shot sleeve may include that the nickel-based alloy is a solid solution hardened alloy.

In addition to one or more of the features described above, or as an alternative, further embodiments of the shot sleeve may include that the nickel-based alloy is a low volume fraction precipitation hardened alloy.

In addition to one or more of the features described above, or as an alternative, further embodiments of the shot sleeve may include that the nickel-based alloy is a high volume fraction low density precipitation hardened alloy.

In addition to one or more of the features described above, or as an alternative, further embodiments of the shot sleeve may include that the nickel-based alloy is a high density creep resistant alloy.

In addition to one or more of the features described above, or as an alternative, further embodiments of the shot sleeve may include that the nickel-based alloy is a dual precipitation hardened alloy.

In addition to one or more of the features described above, or as an alternative, further embodiments of the shot sleeve may include internal cooling channels formed therein.

Technical effects of embodiments of the present disclosure include a low modulus shot sleeve for high temperature die casting. Further technical effects include a shot sleeve with improved life cycle and durability for high temperature die casting.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1A:
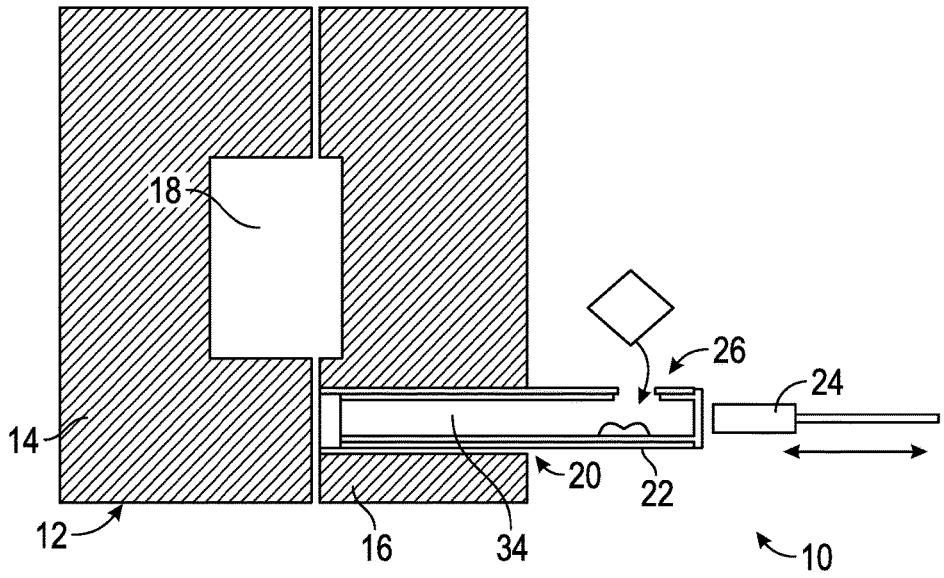
FIG. 1A is a schematic illustration of an example mold assembly that can incorporate embodiments described herein.

As shown and described herein, various features of the disclosure will be presented. Various embodiments may have the same or similar features and thus the same or similar features may be labeled with the same reference numeral, but preceded by a different first number indicating the Figure Number to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1A schematically illustrates an example die casting mold assembly 10 that includes a die casting mold 12 having a first part 14 and a second part 16 that define a mold cavity 18. The die casting mold 12 includes an opening 20 that receives a shot sleeve 22. The shot sleeve 22 defines a bore 34 through which molten material 26 can be injected into the mold cavity 18. A piston 24 operable and movable within the bore 34 of the shot sleeve 22 to inject the molten material 26 into the mold cavity 18. In some die casting operation, the molten material 26 can be heated to temperatures in excess of 2000° F. (1093° C.) in order to ensure proper fluidity of the molten material 26. That is, the temperatures are high enough to ensure that the molten material 26 can be pushed through the bore 34 of the shot sleeve 22 by the piston 24. In view of this, the material used to form the shot sleeve 22 must be compatible with the excessive temperatures of the molten material 26.

Figure 1B:
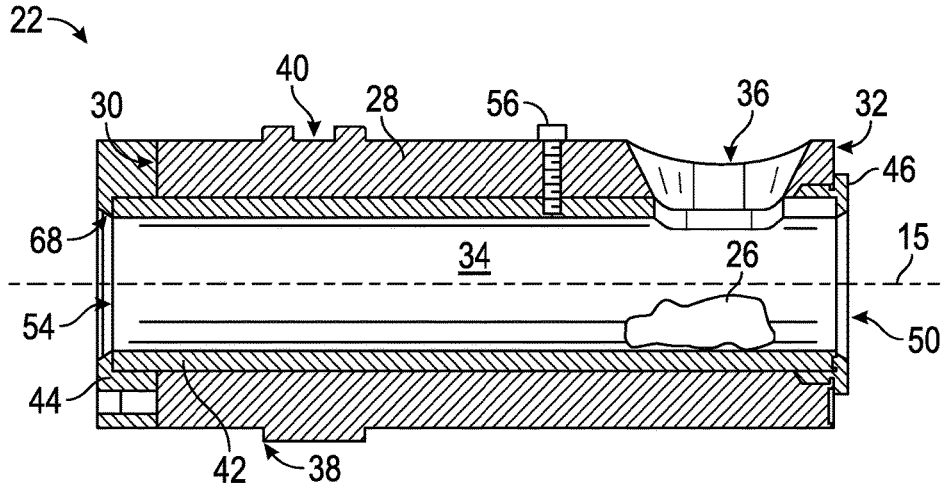
FIG. 1B is a cross-section schematic illustration of the shot sleeve of the mold assembly of FIG. 1A.

Referring to FIG. 1B, the shot sleeve 22 includes a housing 28 with a first end 30 and a second end 32. The bore 34 is defined within the housing 28 about a longitudinal axis 15 and extends from the first end 30 to the second end 32. The bore 34 is opened at both the first and second ends 30, 32, and thus defines a fluid passage within the shot sleeve 22. The first end 30 includes a first end opening 54 that fluidly connects the bore 34 with the mold cavity 18 when the shot sleeve 22 is connected to the die casting mold 12. As shown, in some configurations, the shot sleeve 22 can include a core 42. The core 42 is received within the bore 34 and can provide an interior surface capable of withstanding the temperatures of the molten material 26.

The shot sleeve 22 illustrated in FIG. 1B includes a first cover 44 that is attachable to the housing 28 by fasteners or other attachment mechanism. The first cover 44 is fabricated from a material determined to withstand the impact and wear encountered due to interaction with the die casting mold assembly 10. The first cover 44 includes an opening that is part of the first end opening 54

The first cover 44, as shown, is a separate piece from the housing 28 and thereby may be removed and replaced without having to replace the entire housing 28. Similarly, the core 42 is fit within the bore 34 of the housing 28 such that it may be removed and replaced due to wear and/or if damaged without replacing the entire shot sleeve 22. The first cover 44 includes a shoulder 68 against which the core 42 abuts at the first end 54.

A second cover 46 is attached to the housing 28 at the second end 32. The second end 32 of the housing 28 and the second cover 46 includes a second end opening 50 through which the piston 24 may be inserted and move therethrough to drive the molten material 26 through the shot sleeve 22 and out the first end opening 54. Molten material 26 can be poured through a supply opening 36 such that the molten material 26 can fill the bore 34.

An optional key 56 can extend through the housing 28, as shown in FIG. 1B, and engage a surface of the core 42 to prevent rotation of the core 42 relative to the housing 28 and to maintain an alignment of the openings 50, 54. The housing 28 further includes an integral collar portion 38 formed on an exterior surface of the housing 28, including flats 40 that are utilized and provide for engagement of a tool, as known in the art. Additional flanges and/or other structures can be configured on the exterior surface of the housing 28.

The die casting mold assembly 10, as noted above, is subject to high temperatures due to the manufacturing process of a component formed within the die casting mold 12. Because of the high temperatures, the components of the die casting mold assembly 10 may suffer low part life (e.g., relatively low number of operations before one or more components should be replaced or repaired). Accordingly, as provided herein, improved shot sleeves having drastically improved part life are described.

For example, machines capable of high temperature die casting of aerospace components may require molten nickel-based alloy. In such manufacturing, metal is melted in a crucible (e.g., molten material 26) and poured through the supply opening 36 into the bore 34 of the shot sleeve 22. The piston 24 is then inserted into the bore 34 and injects the molten material 26 into the die casting mold at high velocity and pressure. The molten material 26 fills the mold cavity 18 which defines a part geometry, such as several aerospace components, and the molten material 26 cools within the mold cavity 18 to solidify and form a finished part or component. The first part 14 and second part 16 of the die casting mold 12 are then separated or opened, the part(s) ejected from the die casting mold 12, and the cycle initiates again. This is referred to as a "shot cycle" (i.e., the full process of forming a component with the die casting mold assembly 10.

It is advantageous to maximize the number of shot cycles that can be performed before components of the die casting mold assembly 10 exposed to the molten material 26 need to be replaced. In particular the shot sleeve 22 must remain dimensionally accurate for clearance and movement of the piston 24 while being exposed to the high temperature of the molten material 24 that is poured into the bore 34 before and after metal injection. As known in the art, the shot sleeve can fail from thermal mechanical fatigue induced by the rapid introduction and expulsion of the molten material 26 through in each shot cycle.

As provided herein, an extended-life shot sleeves formed of materials with superior thermal-mechanical fatigue resistance are disclosed. In accordance with some embodiments, an example material for such application (e.g., formation of the shot sleeve) is nickel-based single crystal which can be grown to orient a low modulus direction in the axial and tangential or hoop directions. Axial and tangential or hoop low modulus shot sleeve can be fabricated and made in the size of a die casting shot sleeve as described herein. Advantageously, in accordance with embodiments of the present disclosure, several thousand shot cycles are possible with the materials described herein. That is, as will be appreciated by those of skill in the art, a ten-fold improvement (or greater) can be achieved with embodiments of the present disclosure.

A shot sleeve of the present disclosure is a nickel-based alloy shot sleeve having single crystal structure. The single-crystal, nickel-based alloy shot sleeve is cast with a controlled modulus of the nickel crystal. By controlling the modulus of the nickel crystal during casting, a low modulus direction (e.g., cubic geometry) can be achieved with a high ductility orientation. In some embodiments, the casting of the shot sleeve can be achieved by growing a single-crystal, nickel-based alloy ingot and then forging the ingot into a shot sleeve (e.g., having a structural shape similar to that shown in FIG. 1B).

The single-crystal, nickel-based alloy with a low modulus, because of a high thermal-mechanical fatigue resistance, can eliminate the core 42. That is, the entire shot sleeve can be formed as a single unitary component that is formed from single-crystal, nickel-based alloy.

To achieve the improved shot sleeve of the present disclosure, an ingot of single-crystal, nickel-based alloy can be grown. The ingot can then be slow cooled, heat treated to soften the material. The softened material can then be forged to form the shot sleeve shape, size, and dimensions. The formed shape can then be heat treated to achieve a fine textured sub-grained structure that exhibits improved strength and low cycle fatigue.

A conventional single crystal does not have axial symmetry. However, by a special seeding process a single crystal, axial symmetry can be achieved, thus resulting in improved-life materials, and, accordingly, improved-life shot sleeves. Axial symmetry may also be achieved by bending a sheet of single crystal in its softened stage and welding the two edges to form a cylindrical tube.

In one non-limiting embodiment of the present disclosure, a nickel-based alloy shot sleeve is provided. The nickel-based alloy shot sleeve is a single crystal grown to have a controlled modulus of the crystal. For example, in some embodiments, the atoms of the grown nickel-based alloy crystal can have a cubic geometry that provides a low modulus direction, resulting in a low thermally driven stress orientation.

Figure 2:
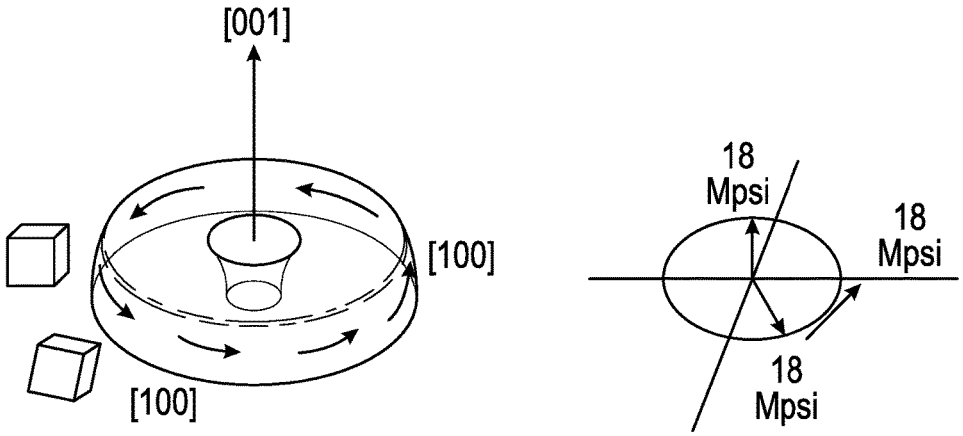
FIG. 2 illustratively shows a specially cast single crystal orientation as employed by embodiments of the present disclosure where both axial and hoop directions everywhere are low modulus.

As shown in FIG. 2, an orientation as employed by embodiments of the present disclosure is illustratively shown. As illustrated, a cubic geometry is formed by a normally used single crystal casting technique. This case, low modulus occurs tangentially every 90° interval. These locations can be selectively oriented at the bottom of the shot tube where liquid metal will flow. Such selection and orientation may provide improved and unexpected benefits of significant life-cycle of the shot sleeves of the present disclosure.

The modulus of the material provided herein may have a first axis having a modulus of 18-22 Mpsi, and in some embodiments, having a modulus of 28-32 Mpsi at room temperature. Further, in some embodiments, a radial direction may have a modulus of 18-22 Mpsi, and in some embodiments may have a modulus of 28-32 Mpsi. In all cases, the tangential or hoop modulus at room temperature may be preferred to be 18-22 Mpsi.

In accordance with various embodiments, the nickel-based, single crystal alloy can include various different materials. For example, alloys of the present disclosure may take the form of Ni-$M_1$-$M_2$- . . . -$M_n$, wherein $M_1$ to $M_n$ are metals that are alloyed with nickel to achieve the desired properties. In various embodiments, a single additional metal ($M_1$) may be alloyed with nickel, and in other various embodiments different numbers of alloyed metals $M_1$ to $M_n$ can be employed. In some embodiments, the alloyed metals may include solid solution hardened alloys such as Hastelloy-X® or low volume fraction precipitation hardened alloy such as Waspaloy®, or high volume fraction low density precipitation hardened alloy such as Inconel® Alloy 100, or high density but creep resistant alloys such as PWA 1484, René N5, or CMSX-4 alloy, or even dual precipitation hardened alloy such as Inconel® Alloy 718. Additionally, as will be appreciated by those of skill in the art, the different materials (including nickel-based or iron-based or steels) may take different weight percentages, as illustrated by the preceding example(s) and understood by those of skill in the art.

In additional to the above described shot sleeves, in some embodiments, the formation and casting of the shot sleeve may be configured to form cooling channels within the shot sleeve. That is, in addition to providing the above described and formed shot sleeve that is formed from the described nickel-based alloy, additional features, such as cooling channels can be employed to further improve efficiency and/or part life, as desired and/or necessary.

Advantageously, embodiments described herein provide shot sleeves having several thousand shot cycles. That is, as will be appreciated by those of skill in the art, a ten-fold improvement (or greater) can be achieved with embodiments of the present disclosure. A low modulus single-crystal shot sleeve, as provided herein, can enable a high temperature die casting process to make improved thermo-mechanical-failure life of shot sleeves. Such improved shot sleeves can minimize issues with sleeve deflection and clearance control during die casting of components. Furthermore, advantageously, embodiments provided herein can enable increased fabrication rates and lower cost than alternative casting and forging processes.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. A shot sleeve for high temperature die casting formed from a single crystal, nickel-based alloy, the shot sleeve having a single-crystal structure with an axi-symmetrical orientation and a low modulus direction oriented to provide a higher thermal-mechanical fatigue resistance along an axial direction of the shot sleeve than in a radial direction.

2. The shot sleeve of claim 1, wherein the single crystal, nickel-based alloy has a first axis with a modulus of 18-22 Mpsi at room temperature.

3. The shot sleeve of claim 2, wherein the single crystal, nickel-based alloy has a radial direction with a modulus of 28-32 Mpsi.

4. The shot sleeve of claim 2, wherein the single crystal, nickel-based alloy has a radial direction with a modulus of 18-22 Mpsi.

5. The shot sleeve of claim 4, wherein the single crystal, nickel-based alloy has a tangential or hoop direction with a modulus of 18-22 Mpsi.

6. The shot sleeve of claim 1, wherein the nickel-based alloy is a solid solution hardened alloy.

7. The shot sleeve of claim 1, wherein the nickel-based alloy is a low volume fraction precipitation hardened alloy.

8. The shot sleeve of claim 1, wherein the nickel-based alloy is a high volume fraction low density precipitation hardened alloy.

9. The shot sleeve of claim 1, wherein the nickel-based alloy is a high density creep resistant alloy.

10. The shot sleeve of claim 1, wherein the nickel-based alloy is a dual precipitation hardened alloy.

11. The shot sleeve of claim 1, further comprising internal cooling channels formed therein.

* * * * *